US005416972A

United States Patent [19]

Sugiura et al.

[11] Patent Number: 5,416,972

[45] Date of Patent: May 23, 1995

[54] METHOD OF MANUFACTURING JOINT TERMINALS FOR BUS BARS

[75] Inventors: Tomohiro Sugiura; Kunihiko Takeuchi, both of Shizuoka, Japan

[73] Assignee: Yazaki Corporation, Japan

[21] Appl. No.: 163,701

[22] Filed: Dec. 9, 1993

[30] Foreign Application Priority Data

Dec. 10, 1992 [JP] Japan ..... 4-330506

[51] Int. Cl.[6] ..... H01R 43/16

[52] U.S. Cl. ..... 29/874; 439/76

[58] Field of Search ..... 29/874, 882, 884; 439/76, 212, 213

[56] References Cited

U.S. PATENT DOCUMENTS 4,586,775 5/1986 Nestor et al. ..... 439/395
4,959,019 9/1990 Shimochi ..... 439/76
5,057,026 10/1991 Sawai et al. ..... 439/76

FOREIGN PATENT DOCUMENTS 57-133880 8/1982 Japan .
64-27969 2/1989 Japan .
6790 1/1993 Japan ..... 29/874

OTHER PUBLICATIONS

MALCO, "Wrapost Jumper Clips" Advertisement, 1964.

*Primary Examiner*—Mark Rosenbaum
*Assistant Examiner*—David P. Bryant
*Attorney, Agent, or Firm*—Sughrue, Mion, Zinn, Macpeak & Seas

[57] ABSTRACT

A joint terminal for bus bars and a method for manufacturing same from a concatenated strip of terminals. A plurality of female-female terminals having bus bar engaging portions at lower portions thereof are united together through a uniting strip and removed as desired to be connected to the bus bars via the engaging portions.

9 Claims, 5 Drawing Sheets

METHOD OF MANUFACTURING JOINT TERMINALS FOR BUS BARS

BACKGROUND OF THE INVENTION

1. Field of the Invention

The invention relates to a joint terminal for bus bars used in junction boxes or the like and applied to electric circuits in automobiles, and to a method for manufacturing such joint terminals.

2. Related art

FIG. 6 shows a relay circuit in a junction box or the like. With respect to terminals $c_1$, $c_2$ of a coil c and terminals $s_1$, $s_2$ of a switch s in a relay a, terminals $c_1$, $s_1$ are connected to a common circuit b, whereas terminals $c_2$, $s_2$ are connected to separate circuits d, e. In the junction box, the circuits b, d, e are formed of bus bars, each made of a belt-like electrically conductive metal plate (cf. Japanese Unexamined Utility Model Application No 64-27969).

In this case, it is necessary to prepare various types of bus bars depending on the location of the relay, thus increasing the manufacturing cost due to an increased number of molds involved.

SUMMARY OF THE INVENTION

The invention has been made in view of the above circumstances. Accordingly, the object of the invention is to provide a joint terminal for bus bars and a method for manufacturing same, wherein a bus bar is provided with a branch circuit, while a joint terminal is formed by uniting a plurality of connecting portions together through a uniting strip.

To achieve the above object, the invention involves a method of manufacturing a joint terminal for bus bars, which includes the steps of: preparing a concatenated developed terminal by uniting a plurality of developed terminal portions together through uniting strips; and separating terminal portions from the concatenated developed terminal and bending the separated terminal portions to thereby obtain a variety of types of joint terminals for bus bars. Each developed terminal portion is formed by integrating a lower female terminal portion with an upper female terminal portion through an intermediate plate portion, the lower female terminal portion having a resilient contact strip on a surrounding wall thereof and the upper female terminal portion having a resilient contact strip on a surrounding wall thereof.

The joint terminal for bus bars is formed by uniting a plurality of female-female terminals together through a uniting strip, each female-female terminal having a bus bar engaging portion on a lower portion thereof.

The joint terminal for bus bars may also be formed by uniting a terminal portion with a female-female terminal together through a uniting strip, the female-female terminal having a bus bar engaging portion on a lower portion thereof.

The joint terminal for bus bars may also be formed by unitizing a plurality of female terminal portions through uniting strips, each female terminal portion having a bus bar engaging portion.

By connecting the connecting portion or connecting portions of the joint terminal to a bus bar or bus bars, the bus bar is provided with a branch terminal portion or branch circuit immediately.

BRIEF DESCRIPTION OF THE DRAWINGS

FIG. 1 (B) is a perspective view showing a connected state;

FIG. 2 (B) is a perspective view showing a connected state;

FIG. 3 (B) is a perspective view showing a connected state;

FIG. 4 (B) is a perspective view showing a connected state;

DETAILED DESCRIPTION OF THE PREFERRED EMBODIMENTS

Figure 1A:
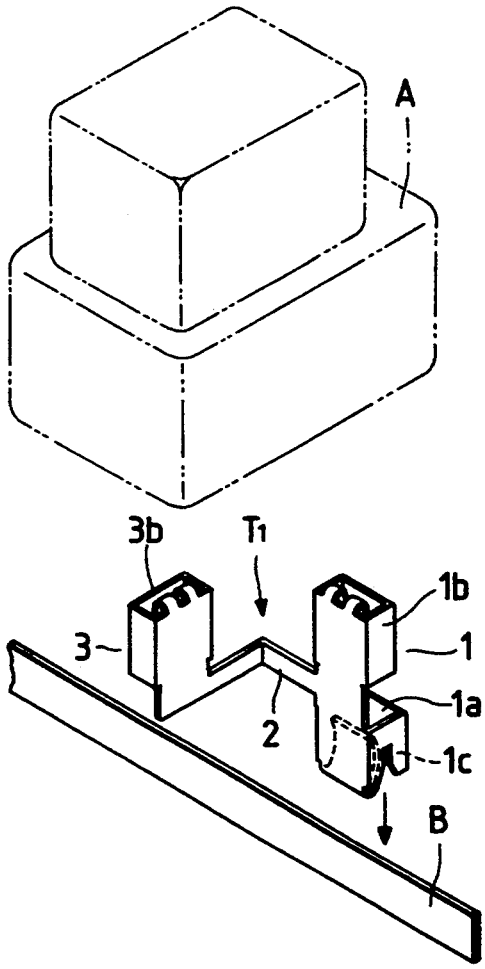
FIG. 1 (A) is an exploded perspective view showing an embodiment of the invention.
Figure 1B:
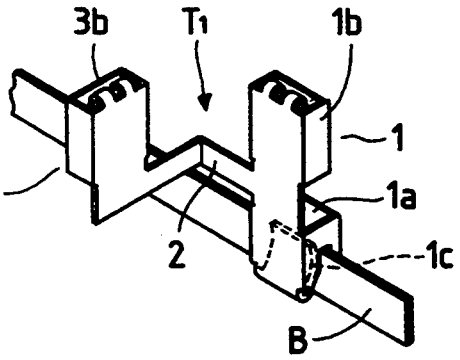

Preferred embodiments of the present invention will now be described with reference to the accompanying drawings In FIGS. 1 (A) and (B), reference character B designates a bus bar in a junction box; and $T_1$, a joint terminal.

The joint terminal $T_1$ includes: a female-female terminal portion 1 and a branch terminal portion 3. The female-female terminal portion 1 has a lower portion 1*a* and an upper portion 1*b*, and the branch terminal portion 3 has only an upper female terminal portion 3*b*. Both terminal portions 1 and 3 are united together through a bent uniting strip 2. A slit lc is formed on the lower portion 1*a* of the female-female terminal portion 1, so that the bus bar B in upright position can be received therein and is engaged therewith.

With the joint terminal $T_1$ connected to the bus bar B through the lower portion 1*a* of the female-female terminal portion 1, the upper female terminal portions 1*b*, 3*b* are positioned so that connecting terminals (not shown) of a relay A can be received therein.

Figure 2A:
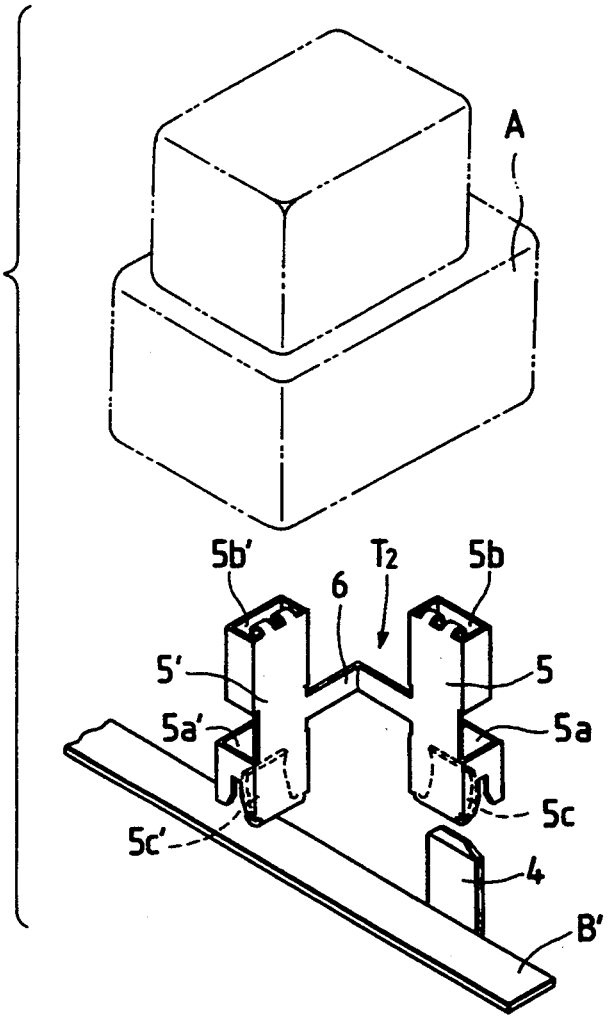
FIG. 2 (A) is an exploded perspective view showing another embodiment of the invention.
Figure 2B:
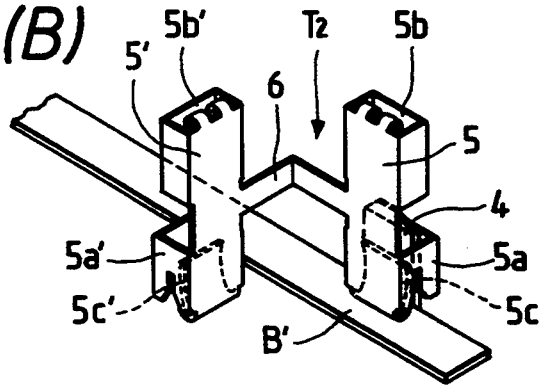

In FIGS. 2 (*a*) and (*b*), a bus bar B' in flatly laid position has a raised Lab terminal portion 4. A joint terminal $T_2$ is formed by uniting female-female terminal portions 5, 5' together through a bent uniting strip 6. With the joint terminal $T_2$ connected to the tab terminal portion 4 through a lower portion 5*a* of the female-female terminal portion 5, upper portions 5*b*, 5*b* ' of the female-female terminal portions 5, 5' are positioned so as to receive the connecting terminals of the relay A. Slits 5*c*, 5*c'* are formed on the lower portions 5, 5' so that bus bars can be engaged therewith.

Figure 3A:
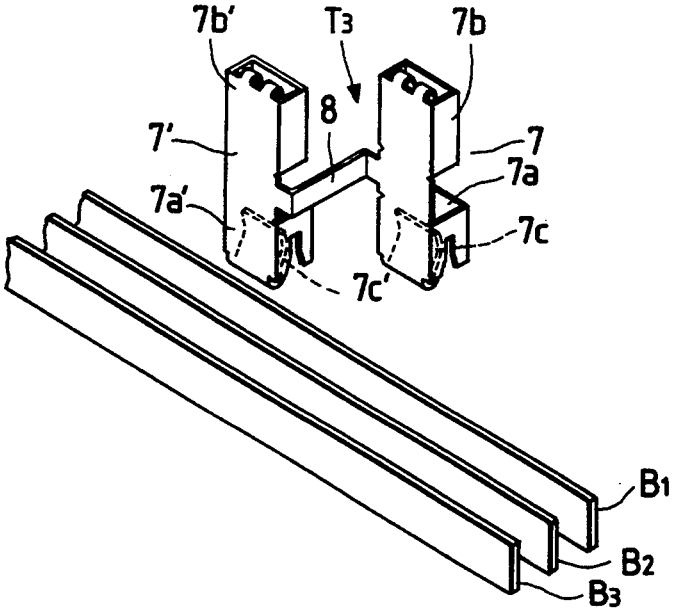
FIG. 3 (A) is an exploded perspective view showing still another embodiment of the invention.
Figure 3B:
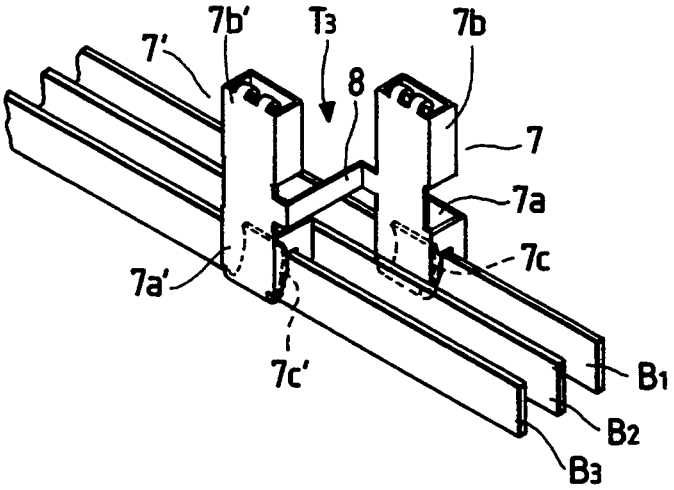

In FIGS. 3 (*a*) and (*b*), bus bars $B_1$, $B_2$, $B_3$ are disposed in upright position. A joint terminal $T_3$ is formed by uniting female-female terminal portions 7, 7' together through a bent uniting strip 8, the female-female terminal portions 7, 7' respectively having lower portions 7*a*, 7*a'* and upper portions 7*b*, 7*b'*. The joint terminal $T_3$ is engaged with the bus bars $B_1$ and $B_3$ through slits $7_c$, $7_c'$ formed on the lower portions 7*a*, 7*a'*, so that a branch circuit is formed of the bus bar $B_3$ with respect to the bus bar $B_1$. By varying the bending condition of the bent uniting strip 8, the female-female terminal portion 7 and the female-female terminal portion 7' are aligned in parallel with each other, so that the bent uniting strip 8 is distant from the bus bar $B_2$ in the middle so as not to come in contact therewith when the joint terminal $T_3$ is connected to the bus bars $B_1$, $B_3$.

Figure 4A:
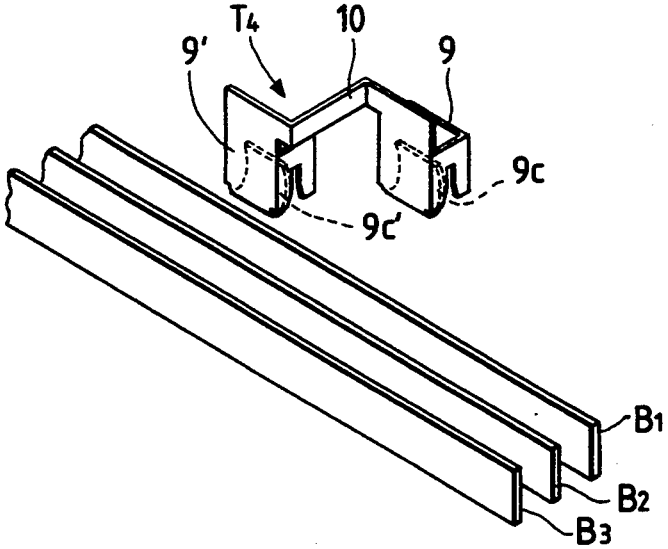
FIG. 4 (A) is an exploded perspective view showing still another embodiment of the invention.
Figure 4B:
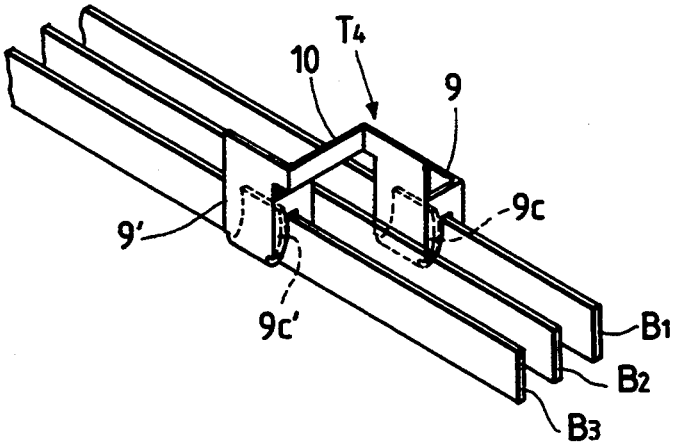

In FIG. 4 (*a*) and (*b*), a joint terminal $T_4$ is formed by uniting a pair of female terminal portions 9, 9' together through a bent uniting strip 10. By connecting the joint terminal $T_4$ to the bus bar $B_1$, $B_3$ through slits 9c, 9c', a branch circuit is formed of the bus bar $B_3$ with respect to the bus bar $B_1$. The bent uniting strip 10 is remote from the bus bar $B_2$ in the middle.

Figure 5:
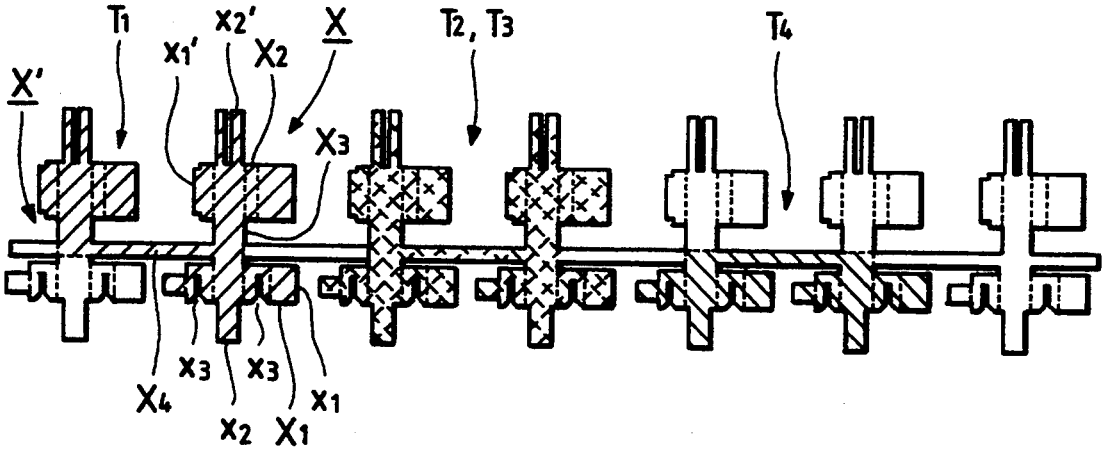
FIG. 5 is a plan view showing a concatenated developed terminal.
Figure 6:
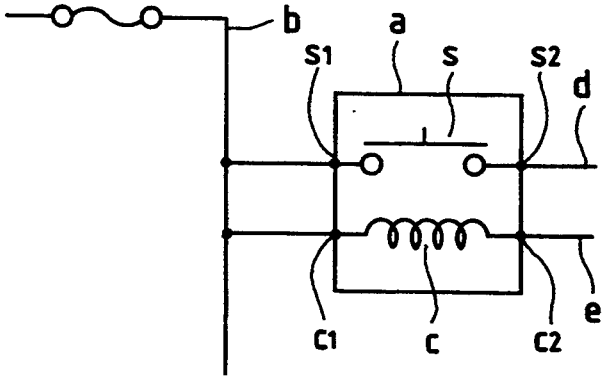
FIG. 6 is a diagram showing a relay circuit.

FIG. 5 shows a punched concatenated developed terminal X' for forming the joint terminals $T_1$, $T_2$, $T_3$, and $T_4$. A plurality of developed terminal portions X are united together through uniting strips $X_4$. Each developed terminal portion X is formed by uniting an upper female terminal portion $X_2$ and a lower female terminal portion $X_1$ together through an intermediate plate portion $X_3$. The upper female terminal portion $X_2$ has a folding resilient contact strip $x_2'$ in the middle of a surrounding wall $x_1'$ thereof and the lower female terminal portion $X_2$ has not only a folding resilient contact strip $x_2$ in the middle of a surrounding wall $x_1$ but also a slit forming portions $x_3$ on the confronting portions of the surrounding wall $x_1$.

The joint terminal $T_1$ is formed by separating a portion hatched with lines drawn from upper right to lower left from the concatenated terminal X'; the joint terminals $T_2$, $T_3$ are formed by separating a portion hatched with crosses therefrom; and the joint terminal $T_4$ is formed by separating a portion hatched with lines drawn from upper left to lower right.

Since the invention is characterized as described above, a branch terminal portion can be provided easily with respect to a bus bar by arranging a plurality of terminal portions in a joint terminal that is to be engaged with bus bars. Therefore, by dispensing with the process of working bus bars, the process and cost involved in manufacturing the bus bar circuit of this type can be curtailed significantly.

Further, a plurality of types of joint terminals can be produced with ease by, modifying the portions to be separated from the concatenated developed terminal.

What is claimed is:

1. A method of manufacturing a joint terminal for connecting a plurality of bus bars, said method comprising the steps of:

forming a concatenated terminal by integrally connecting a plurality of terminals on a uniting strip, each of said terminals comprising substantially flat upper and lower terminal portions separated by the uniting strip, the upper and lower terminal portions each being connected to the uniting strip by a substantially flat intermediate portion, and each having a resilient contact strip and a surrounding wall portion;

separating at least two adjacent terminal portions from the concatenated terminal, the separated terminal portions remaining connected together by a portion of the uniting strip; and bending the contact strip and the surrounding wall portion of each of the separated terminal portions, and the connecting portion of the uniting strip, in a predetermined manner to obtain a joint terminal for connecting the plurality of bus bars.

2. A method of manufacturing a joint terminal as recited in claim 1, wherein the step of bending the contact strips and the surrounding wall portions comprises the steps of:

bending the contact strips toward the connecting portion of the uniting strip; and bending the surrounding wall portions around the bent contact strips to form female terminals.

3. A method of manufacturing a joint terminal as recited in claim 1, wherein the separating step comprises the step of:

separating from the concatenated terminal one of the terminals and only one of the upper and lower terminal portions of an adjacent terminal connected to the one terminal by a portion of the uniting strip to form a joint terminal having three terminal portions.

4. A method of manufacturing a joint terminal as recited in claim 1, wherein the separating step comprises the step of:

separating adjacent lower terminal portions connected to each other by a portion of the uniting strip to form a joint terminal having two lower terminal portions.

5. A method of manufacturing a joint terminal as recited in claim 4, further comprising the step of forming two slits in the surrounding wall portion of each of the lower terminal portions for engagement with a bus bar.

6. A method of manufacturing a joint terminal as recited in claim 1, wherein the separating step comprises the step of:

separating adjacent terminals to form a joint terminal having two upper terminal portions and two lower portions.

7. A method of manufacturing a joint terminal as recited in claim 1, wherein the separating step comprises the step of:

separating a plurality of adjacent terminals to form a joint terminal having a plurality of upper terminal portions and a plurality of lower terminal portions.

8. A method of manufacturing a joint terminal as recited in claim 1, wherein the intermediate portions of the separated terminal portions are also bent to obtain the joint terminal.

9. A method of manufacturing a joint terminal for connecting a plurality of bus bars, said method comprising the steps of:

forming a concatenated terminal by integrally connecting a plurality of terminals on a uniting strip, each of said terminals comprising substantially flat upper and lower terminal portions separated by the uniting strip, the upper and lower terminal portions each being connected to the uniting strip by a substantially flat intermediate portion, and each having a resilient contact strip and a surrounding wall portion;

separating at least two adjacent terminal portions from the concatenated terminal, the separated terminal portions remaining connected together by a portion of the uniting strip; and bending the contact strip and the surrounding wall portion of each of the separated terminal portions, and the intermediate portion of at least one of the separated terminal portions, in a predetermined manner to obtain a joint terminal for connecting the plurality of bus bars.

* * * * *